US005551569A

United States Patent [19]

Garvin-Mazzarisi

[11] Patent Number: 5,551,569

[45] Date of Patent: Sep. 3, 1996

[54] BAG DISPENSER AND TEMPORARY PET WASTE RECEPTACLE

[76] Inventor: Joni M. Garvin-Mazzarisi, 11640 NW. 39th St., Coral Springs, Fla. 33065

[21] Appl. No.: 349,810

[22] Filed: Dec. 6, 1994

[51] Int. Cl.[6] ..... B65F 1/06

[52] U.S. Cl. ..... 206/554; 206/457; 220/908

[58] Field of Search ..... 206/554, 457, 206/223; 220/908, 909

[56] References Cited

U.S. PATENT DOCUMENTS

| | | | |
|---|---|---|---|
| 4,522,150 | 6/1985 | Gershman . | |
| 4,816,000 | 3/1989 | Hsu | 206/457 X |
| 4,951,605 | 8/1990 | Brown . | |
| 5,211,133 | 5/1993 | Foley . | |
| 5,259,340 | 11/1993 | Arbogast . | |
| 5,295,607 | 3/1994 | Chang | 220/908 X |
| 5,386,909 | 2/1995 | Spector | 206/457 |

*Primary Examiner*—Jacob K. Ackun
*Attorney, Agent, or Firm*—McHale & Slavin, P.A.

[57] ABSTRACT

The instant invention is a plastic bag dispenser and waste receptacle for use in the care and maintenance of domestic animals. A hollow animal structure having a first concealed chamber is available for placement of plastic bags and various maintenance tools for use in servicing the relief station of a domestic pet. The plastic bags are used to receive pet waste such as cat litter. A second concealed chamber is accessible through a trap door for temporary placement of the pet waste. The device allows for more frequent maintenance of a pet's relief area by providing the necessary maintenance items to maintain the waste in a closed and sealed chamber where they can be disposed of at the convenience of the pet's owner.

15 Claims, 2 Drawing Sheets

FIG. 1
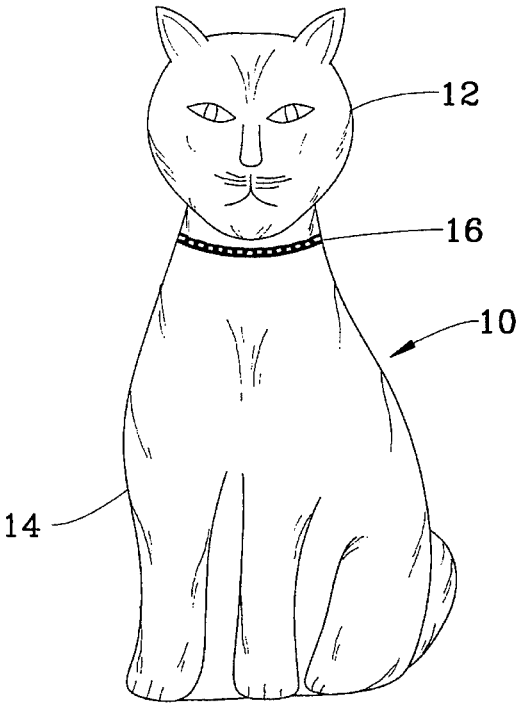
FIG. 2
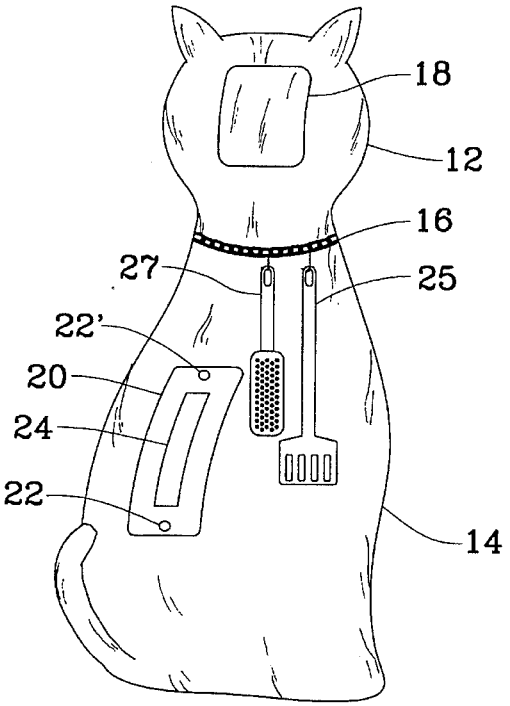
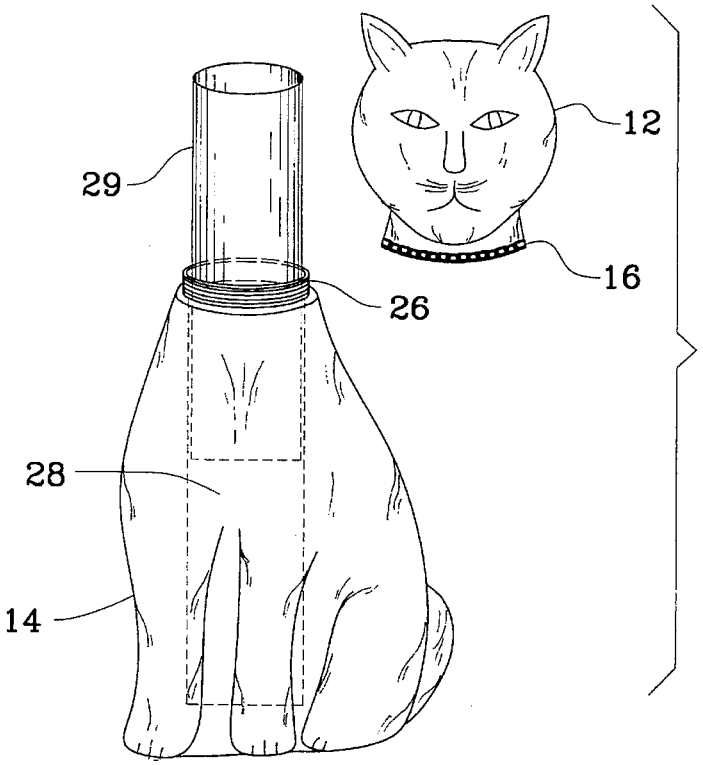
FIG. 3

BAG DISPENSER AND TEMPORARY PET WASTE RECEPTACLE

FIELD OF THE INVENTION

This invention is related to the care and maintenance of domestic animals and more particularly to a waste dispenser which operates as a storage container for holding animal waste for subsequent disposal.

BACKGROUND OF THE INVENTION

Domestic animals are well known for their ability to entertain and provide company to their owners. Commonly referred to as pets, the animals have become a main stay of the modern family. However, the domestication of a pet requires the owner to provide every need to the pet such as a balanced daily diet and a regular supply of fresh water to maintain health and longevity. The problem arises in disposal of the pet's natural waste products.

Most pets are confined to the family home and dependent upon the owner to provide an area readily available to relieve bodily functions. For instance, the droppings from a bird are typically caught on disposable paper placed along the bottom of a bird cage. Pets including hamsters, gerbils, rabbits, and the like may be placed in a cage requiring similar maintenance. Dogs and cats require maintenance but usually are left to roam the family home without confinement to a cage.

Cats are of particular interest due to their fetish for cleanliness. Known as one of the more intelligent house pets, cats will instinctively use a litter box filled with a granular clay commonly used to absorb cat waste. When litter is moistened, it forms a ball type clump that quickly dries and can be easily removed by the use of a strainer. However, cats will not use a litter box if it is not well maintained. For this reason, regular cleaning of a litter box is a necessity for the animal's health as well as the overall hygiene of the family home. Should the cat detect that no area of the litter box is acceptable, the cat will avoid the litter box leading to unsanitary conditions in the home.

One method of cleaning the litter box is to simply dispose of all the litter every few days. This option is expensive and requires the owner to transport the contents of the litter box to a disposal container for refill as necessary. As previously mentioned, the owner may also maintain the litter box in a usable condition by simply scooping out spoiled litter and replacing it as necessary.

A number of U.S. Patents have issued addressing various ways to dispose of pet waste and, in particular, to the maintenance of a cat litter box. U.S. Pat. No. 5,259,340 discloses a device on guide tracks to move litter over a screen thereby separating the waste product for proper disposal.

U.S. Pat. No. 5,249,549 discloses a disposable litter container for cats based upon a molded tray of water absorbent paper material.

U.S. Pat. No. 5,211,133 discloses a litter saving device for the collection and disposal of animal waste. A screen supports a layer of litter and includes a means for separating the waste litter. This device does not provide for temporary storage of spoiled litter and is simply used as a replacement for the conventional litter scoop.

U.S. Pat. No. 4,522,150 discloses a cat litter disposal housing sized to accommodate a cat. The device includes a rounded top and removable litter tray placed along a bottom surface of the housing providing a portable litter box for separation of spoiled litter.

U.S. Pat. No. 4,951,605 discloses a litter disposal system consisting of a bag receptacle held by a tray. The bag is supported in a suspended position and is available for litter placement and use by a cat. After use, the bag can then be sealed and disposed of in a proper manner. This patent discloses the temporary storage of cat litter but relies upon an open container that can lead to odors and the like unsanitary conditions.

While the intentions of the owner are to maintain the litter box in a clean state, unless provided with a device that makes for simplistic cleaning of the litter box, maintenance will not be performed.

Thus, what is needed in the art is an apparatus or device that operates as a constant reminder to the pet owner of the need for cleanliness. The device needs to provide the tools necessary in order to perform the maintenance in a simplified manner further providing an aesthetically pleasing container.

SUMMARY OF THE INVENTION

The instant invention is a multi-purpose container having a plastic bag dispenser and chamber for temporary holding of waste. In one embodiment, the container may be used in conjunction with a domestic cat wherein the container is shaped in the form of a cat and placed next to a litter box. A plastic bag dispenser can be formed from a concealed compartment located along the back of the container. The plastic bags are made available to store waste such as spoiled litter. A child resistant cover for the concealed compartment is available to prevent access to the bags. A removable slot in the middle of the dispenser door allows bags to be dispensed on a one by one basis in situations where no children are present eliminating the need for opening of the bag dispenser door.

The cat embodiment includes a hollow portion which forms an interior chamber for temporary holding of waste. The chamber is concealed by a spring loaded trap door when not in use. The interior chamber may be lined with a reusable sleeve or a disposable bag. Maintenance tools such as a cat litter scoop may be placed within the bag dispenser chamber or attached to the outer surface of the container.

In operation, when litter is spoiled the owner first obtains a plastic bag from the dispenser. By use of a litter scoop the spoiled litter is strained from the fresh litter and placed into the plastic bag. Once the bag has been filled with waste, it is placed into the second interior holding chamber by depressing of the hinged cover which temporary opens an access way to the chamber. Once the filled bag is deposited, the hinged cover returns to its closed position concealing the filled bags until the owner deems it necessary to dispose of the waste.

When the chamber is to be emptied, the chamber can be accessed by removal of the spring operated door. In the preferred embodiment, access is provided by removal of the cat's head which is threaded onto the body of the cat. The bags can then be removed by inverting the cat or more appropriately, by use of a reusable or disposable liner that can be transported to a waste receptacle such as the outside garbage bin for permanent disposal. This allows the owner of the pet the provisions necessary to clean their pets waste in a quick and sanitary mode as well as eliminate the necessity of carrying out the waste multiple times throughout the day.

Thus an objective of the instant invention is to disclose a maintenance device that is shaped in the form of a pet for use in dispensing storage bags and for the temporary holding of animal waste.

Still another objective of the instant invention is to teach the use of a device to provide a constant reminder to the owner of a pet the necessity for maintaining the pet's waste relief area in a clean state providing for increased hygiene to the pet.

Yet still another objective of the instant invention is to disclose a container having sufficient holding volume to provide a more scheduled timing for transporting of collected waste to a permanent waste receptacle.

Still another objective of the instant invention is to provide an aesthetically pleasing bag dispenser having child resistant dispenser compartments.

Yet still another objective of the instant invention is to provide an aesthetically pleasing pet waste receptacle having a concealed chamber to reduce or eliminate odor.

Other objectives and advantages of this invention will become apparent from the following description taken in conjunction with the accompanying drawings wherein are set forth by way of illustration and example, certain embodiments of this invention. The drawings constitute a part of the specification and include exemplary embodiments of the present invention and illustrate various objects and features thereof.

BRIEF DESCRIPTION OF THE DRAWINGS

FIG. 1 is a front view of a cat having the chambers necessary for practice of the instant invention;

FIG. 2 is a rear view of FIG. 1 depicting the access areas to the first and second chambers;

FIG. 3 is an exploded view of FIG. 1 depicting the interior chamber;

DETAILED DESCRIPTION OF THE PREFERRED EMBODIMENT

Figure 4:
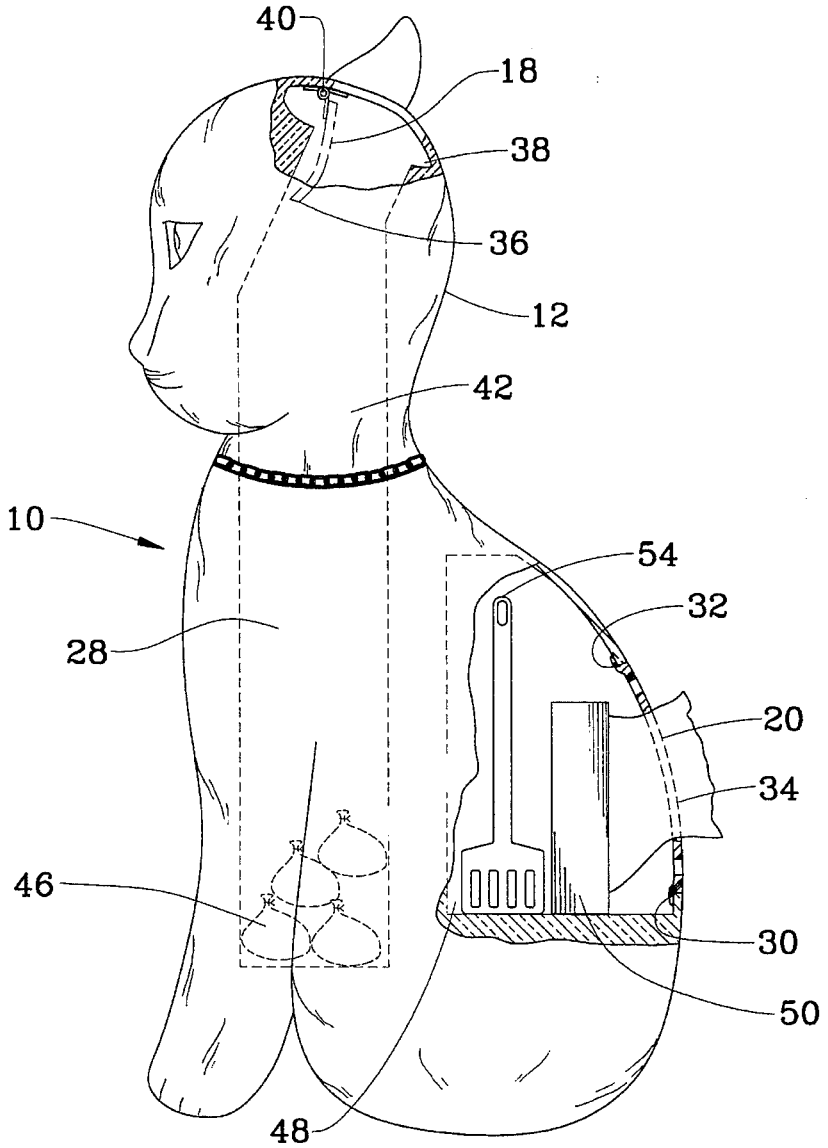
FIG. 4 is a partial cross-sectional side view.

Although the invention is described in terms of a specific embodiment, it will be readily apparent to those skilled in this art that various modifications, rearrangements and substitutions can be made without departing from the spirit of the invention. The scope of the invention is defined by the claims appended hereto.

Now referring in general to FIGS. 1 and 2, set forth is a first embodiment of the instant invention container 10 having bag dispenser and waste receptacle concealed with the figurine of a cat statuette. The container 10 is defined by a head hollow portion 12 coupled to a body portion 14 along a coupling joint 16 discretely concealed as a necklace placed around the neck of the cat. Construction can be plastic, ceramic, or any other suitable material and configured in the shape of any animal figurine. For example, if the device is to be used in conjunction with a pet bird, the appropriate figurine would be the shape of a bird. Similarly, the figurine may take the form of a rabbit and so forth without defeating the intent of this invention in the dispensing of plastic bags and providing a receptacle for holding of waste.

The head portion 12 includes a trap door 18, highlighted for purposes of detailing the door but shaped along the design of the cat's head portion 12, providing access to an entry chamber leading to the confines of the cat body portion 14. As defined later in this specification, the door 18 is available for placement of filled plastic bags providing a one way access to the interior chamber for controlling odors and preventing access by young children.

A holding chamber is provided beneath removable door 20 which operates as a dispenser of plastic bags. Child resistant finger holds 22 and 22' must be grasped by an adult and squeezed together in order to deform the door 20 constructed of plastic allowing the adult to obtain the necessary plastic bags used in holding of the waste. As noted later in this specification, removable access door 24 is available for use in homes where no children will have access to the container allowing plastic bags to be dispensed on a bag by bag basis without removal of the primary access door 20.

The collar 16 operates to conceal neck coupling and may further operate to hold miscellaneous maintenance items for the particular pet. For example, the embodiment discloses the maintenance of a cat thus a litter scoop 25 as well as a hair brush 27 providing for the hygiene of the animal.

Now referring to FIG. 3 the figurine is illustrated with the head portion 12 removed from the body portion 14 along coupling point 16 which is threaded onto the body portion 14 by externally placed engagement threads 26. The interior chamber 28 is sized accordingly allowing for infrequent need for disposal of the litter by use of a hollow body chamber 14 that is enlarged. The inner chamber 28 is available for holding of waste products and can be further lined with a plastic or paper liner allowing the owner of the device to dispose of waste product without having to take the entire device to another receptacle. The chamber 28, shown by hidden lines, can be made as a straight barrel allowing ease of removal of liners and would allow for a reusable plastic liner sleeve 29 that could be removed from the interior chamber 28 allowing the liner 29 to be carried to a larger waste receptacle such as a trash bin on a more scheduled maintenance plan. In the cat embodiment, the body of the cat may be made standard and various cat heads can be placed on the body allowing the apparatus to take on the appearance of various cats without the need for multiple body portions.

In operation, the owner of a cat may have to clean the litter box every couple of hours in order to satisfy their cat that the litter box is clean enough to use. In instances where a litter box is contaminated, the cat may not use the litter box and deposit its waste products in a more unsanitary location. By having an interior chamber 28 sized to accommodate multiple cleanings, it is contemplated that this device would allow the owner to frequently maintain the litter box by simply removing dispensing bags and placing the spent litter into the plastic bag where it is then placed through trap door 18 of the head portion 12 and deposited into the holding chamber 28. As the owner need not have to carry the litter immediately to a permanent waste receptacle, the owner is more likely to maintain the litter box in a cleaner state thus preventing the cat from relieving itself in unwanted areas of the home.

Now referring to FIG. 4 shown is a partial cross-sectional side view of the instant invention 10 depicting the trap door 18 in the head portion 12. The door 18 is shown in an open position having sealing edge 36 shown apart from inner edge 38. The door is biased in a closed position by hinge member 40 to firmly seat end 36 against the inner edge 38 providing a sealed compartment for containment of odors. Opening of the door 18 provides entry to chamber 42 which is coupled to chamber 28 as previously described. Illustrated in the chamber 28 is a plurality of filled waste bags 46 which are stored for subsequent disposal.

The bag dispensing chamber of the device 10 is depicted by numeral 48 having cover 20 locked in position by engagement tabs 30 and 32. In this embodiment cover 24 is removed allowing the plastic bags 52 to be placed through the slot 34 making them available for removal. A roll of plastic bags 50 is placed within the chamber 48. As previously mentioned, cover 24 may be maintained in position wherein the roll of plastic bags 50 can be accessed by removal of the child resistant cover 20 preventing small children from accessing the bags. Chamber 48 can be made to accommodate only the plastic bags or become enlarged for placement of maintenance components such as the litter box cat scoop 54 for concealment when not in use.

Figure 5:
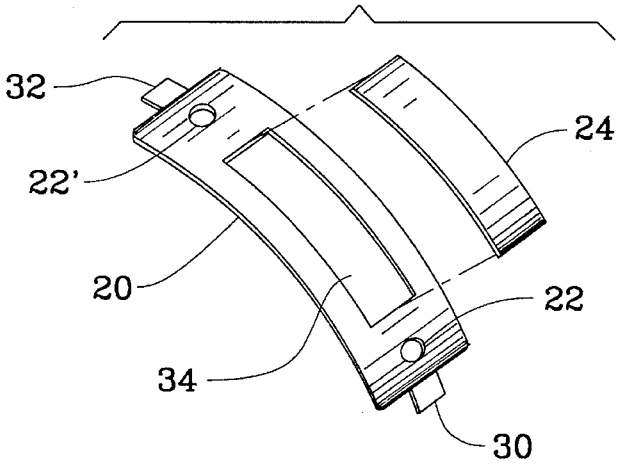
FIG. 5 is a detailed view of the cover for the secondary chamber.

FIG. 5 illustrates an exploded view of the door 20. Finger holes 22 and 22' are provided for use by an adult for removal of the cover 20. Squeezing the cover 20 results in deforming of the plastic door thereby releasing tabs 30 and 32 from securement to the dispensing chamber 48. Removable cover 24 provides access to the plastic bags allowing removal on a sheet by sheet basis without need for removal of the door.

It is to be understood that while I have illustrated and described certain forms of our invention, it is not to be limited to the specific forms or arrangement of parts herein described and shown. It will be readily apparent to those skilled in the art that various changes may be made without departing from the scope of the invention and the invention is not to be considered limited to what is shown in the drawings and described in the specification.

What is claimed is:

1. An apparatus for temporary storage of domestic animal waste comprising: an animal shaped housing means defined by a head portion threadingly secured to a body portion, said head portion including a centrally disposed aperture extending from an upper surface of said head portion leading to said body portion, said body portion having a first chamber juxtapositioned to said head portion and accessible through said aperture; door means for sealing said aperture; and a second chamber disposed in said body portion, said second chamber not communicating with said first chamber; whereby said second chamber is available for storage of a plurality of plastic bags to be used for holding animal waste wherein the bags are filled with waste and inserted into said aperture through said door means for temporary storage in said first chamber, said head portion removable for accessing said first chamber for permanent disposal of waste filled bags.

2. The apparatus according to claim 1 including a slotted cover securable to said second chamber, said slotted cover sized for dispensing plastic bags by individual sheets.

3. The apparatus according to claim 1 including a deformable cover securable to said second chamber, said cover having at least two spaced apart finger holes for use by an adult in removing said cover for accessing said second chamber.

4. The apparatus according to claim 1 wherein said means for sealing said aperture is further defined as a hinged door having a biasing spring to maintain said door in a closed position.

5. The apparatus according to claim 1 wherein said head portion is separated from said body portion by a neck portion, said neck portion having a means for concealing a coupling joint for threadingly securing said head portion to said body portion.

6. The apparatus according to claim 5 wherein said means for concealing said coupling joint is a necklace.

7. The apparatus according to claim 5 including a means for holding a litter scoop.

8. The apparatus according to claim 1 including a means for lining said first chamber.

9. The apparatus according to claim 8 wherein said means for lining is further defined as a reusable plastic liner slidably insertable into said first chamber.

10. The apparatus according to claim 1 wherein said second chamber is sized to accommodate a conventional cat litter scoop.

11. The apparatus according to claim 1 wherein said housing means assimilates a domestic cat.

12. The apparatus according to claim 1 wherein said head portion depicts various cat faces providing alternative cat figurines based on a standardized body portion.

13. An apparatus for temporary storage of spoiled cat litter comprising: a cat shaped housing means defined by a head portion and a neck portion threadingly secured to a body portion, said head portion including a centrally disposed aperture extending from an upper surface of said head portion opening to said body portion, said body portion having a first chamber juxtapositioned to said head portion and accessible through said opening of said aperture; a hinged door including a biasing spring for maintaining said door in a closed position; a second chamber including a deformable cover securable to said second chamber, having at least two spaced apart finger holes for use by an adult in removing said cover for accessing said second chamber, said second chamber not communicating with said first chamber; whereby said second chamber is available for storage of a plurality of plastic bags to be used for holding animal waste wherein the bags are filled with waste and inserted into said aperture through said door for temporary storage in said first chamber, said head portion removable for accessing said first chamber for permanent disposal of waste filled bags.

14. The apparatus according to claim 13 including a means for holding a litter scoop.

15. The apparatus according to claim 13 including a means for lining said first chamber.

* * * * *